US007911158B2

(12) United States Patent
Verbrugh et al.

(10) Patent No.: US 7,911,158 B2
(45) Date of Patent: Mar. 22, 2011

(54) SELF-LEARNING LIGHTING SYSTEM

(75) Inventors: Stefan Marcus Verbrugh, Eindhoven (NL); Michael Cornelis Van Beek, Eindhoven (NL); Constantinus Carolus Franciscus Frumau, Nuenen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 848 days.

(21) Appl. No.: 11/909,504

(22) PCT Filed: Mar. 22, 2006

(86) PCT No.: PCT/IB2006/050888

§ 371 (c)(1),
(2), (4) Date: Sep. 24, 2007

(87) PCT Pub. No.: WO2007/119126

PCT Pub. Date: Oct. 25, 2007

(65) Prior Publication Data

US 2010/0164398 A1 Jul. 1, 2010

Related U.S. Application Data

(60) Provisional application No. 60/664,674, filed on Mar. 23, 2005.

(51) Int. Cl.
*G05F 1/00* (2006.01)
*H05B 37/02* (2006.01)

(52) U.S. Cl. ..... 315/292; 315/293

(58) Field of Classification Search ..... 315/291–295, 315/312, 314–318
See application file for complete search history.

(56) References Cited

U.S. PATENT DOCUMENTS

| | | | | |
|---|---|---|---|---|
| 6,724,159 | B2 | 4/2004 | Gutta et al. | |
| 6,933,685 | B2 * | 8/2005 | Gutta et al. | 315/292 |
| 7,161,556 | B2 * | 1/2007 | Morgan et al. | 345/1.1 |
| 2002/0176073 | A1 | 11/2002 | Mukai | |
| 2003/0057887 | A1 | 3/2003 | Dowling et al. | |
| 2004/0095746 | A1 | 5/2004 | Murphy | |
| 2004/0212323 | A1 | 10/2004 | Gutta et al. | |

FOREIGN PATENT DOCUMENTS

| | | |
|---|---|---|
| JP | 04-206498 | 7/1992 |
| JP | 07-240281 | 9/1995 |
| JP | 11-191492 | 7/1999 |
| JP | 11-283439 | 10/1999 |

OTHER PUBLICATIONS

Co-pending U.S. Appl. No. 60/636,365, "Integrated Light and Fragrance System", filed Dec. 15, 2004 for Benedicte van Houtert and Stefan Verbrugh.

* cited by examiner

*Primary Examiner* — Douglas W Owens
*Assistant Examiner* — Minh D A

(57) ABSTRACT

A system (120) and/or corresponding method introduces a minor change to a given set of parameters (110) that affect an ambiance (130) associated with an environment, and collects the user's response to the change. Based on the user's response, the system learns which changes to which parameters lead to an improved effect. By repeating the change-feedback sessions, the system approaches an optimal setting for achieving the desired ambiance in the given environment. Preferably, the change-feedback session is non-obtrusive, and occurs, for example, each time a light is turned on, and the feedback is collected when the light is turned off, using a multiple switch arrangement. If the light is turned off using one switch, the feedback is positive; if the light is turned off using an alternative switch, the feedback is negative. Alternatively, the system can be placed in a rapid-learning mode, wherein the change-feedback cycles occur more frequently.

16 Claims, 1 Drawing Sheet

SELF-LEARNING LIGHTING SYSTEM

CROSS REFERENCE TO RELATED APPLICATION

This application claims the benefit of U.S. provisional application Ser. No. 60/664,674, filed Mar. 23, 2005, the entire subject matter of which is hereby incorporated by reference.

This invention relates to the field of lighting systems, or other ambiance-affecting systems, and in particular to an ambiance-affecting system that is configured to obtain user feedback as it modifies one or more parameters in the user's environment, and uses this feedback to optimize its future selection of such parameters.

The lighting of an environment has a significant effect on the ambiance associated with the environment. Environments conducive to reading are typically brightly lit; environments conducive to romance are typically dimly lit; and so on. In addition to the luminance level, the chromatic content also affects the ambiance of the environment. A yellow or red tinted light is generally considered to be "warmer" than a blue tinted light. Similarly, the saturation (white content) of the light and other parameters, such as the degree of dispersion of the light, will affect the ambiance.

U.S. Pat. No. 6,724,159, "METHOD AND APPARATUS FOR CONTROLLING LIGHTING BASED ON USER BEHAVIOR", issued 20 Apr. 2004 to Srinivas Gutta, Antonio J. Colmenarez, and Miroslav Trajkovic, and incorporated by reference herein, teaches a lighting system controller that automatically adjusts a lighting device based on user activity.

U.S. Patent application publication 2002/0176073, "ILLUMINATION LIGHT SUPPLY SYSTEM", filed 21 Mar. 2002 for Kenji Mukai, and incorporated by reference herein, teaches an illumination system comprising a plurality of light sources that generate a plurality of colors, and a control unit that allows a user to mix the light output to achieve a desired effect.

U.S. Published Patent Application 2003/0057887, "SYSTEMS AND METHODS OF CONTROLLING LIGHT SYSTEMS", filed 13 Jun. 2002 for Dowling et al., and incorporated by reference herein, discloses a multi-light system wherein the color and intensity of each light, or sets of lights, is controlled from a central controller via wireless communications. A graphic representation of the environment being controlled is used to select and assign control parameters for each light or set of lights. These parameters are stored in a file, and "played back" (i.e. read from the file and communicated to the lights) when desired. The playback may be initiated directly by a user, or programmed to occur according to a defined schedule.

Copending U.S. provisional patent application 60/636,365, "INTEGRATED LIGHT AND FRAGRANCE SYSTEM", filed 15 Dec. 2004 for Benedicte van Houtert and Stefan Verbrugh, and incorporated by reference herein, discloses a lighting system and fragrance-dispersal system that are controlled by a common control system. Preferred combinations of lighting-effects and aromas are used to coordinate the control of each system, so that an adjustment of the lights effects an adjustment of the fragrance-dispersal, and vice versa, thereby simplifying the process of achieving a desired ambiance.

Although advances have been made in easing the task of controlling the various parameters associated with lighting systems, the multi-variate control of luminance, chrominance, saturation, color-balance, and so on, is a complex process that requires at least some level of expertise and/or coordination.

Generally, multi-variate lighting systems are pre-programmed with recommended sets of parameters. These parameters are selected for achieving a desired effect on an 'average' person in an 'average' environment. Not all people and not all environments, however, are accommodated by these pre-programmed sets of parameters and therefore most systems allow users to create different sets of parameters, typically by selecting a predefined set, making adjustments, then storing the resultant set. However, because the interaction among the effects that each parameter produces can be hard for an average user to predict or immediately appreciate, developing an optimal set of parameters to achieve a desired ambiance can be a time-consuming and often frustrating exercise. In most cases, after numerous unsatisfactory attempts to modify a set of parameters to achieve a more preferable lighting effect, the average user merely reverts to choosing from among the pre-programmed sets, or from a few custom-designed sets that are deemed "good-enough".

It is an object of this invention to provide a self-learning ambiance-affecting system, such as a lighting system, that continually strives to improve its ability to achieve a desired ambiance. It is a further object of this invention to provide a self-learning ambiance-affecting system that does not impose a significant burden on the user.

These objects and others are achieved by a system and method that introduces a minor change to a given set of parameters, and collects the user's response to the change. Based on the user's response, the system learns which changes to which parameters lead to an improved effect. By repeating the change-feedback sessions, the system approaches an optimal setting for achieving the desired ambiance in the given environment. Preferably, the change-feedback session is non-obtrusive, and occurs, for example, each time a light is turned on, and the feedback is collected when the light is turned off, using a multiple switch arrangement. If the light is turned off using one switch, the feedback is positive; if the light is turned off using an alternative switch, the feedback is negative. Alternatively, the system can be placed in a rapid-learning mode, wherein the change-feedback cycles occur more frequently.

The invention is explained in further detail, and by way of example, with reference to the accompanying drawings wherein.

Throughout the drawings, the same reference numeral refers to the same element, or an element that performs substantially the same function. The drawings are included for illustrative purposes and are not intended to limit the scope of the invention.

This invention is presented using the paradigm of a lighting system that provides a desired ambiance to an environment. In view of this disclosure, however, one of ordinary skill in the art will recognize that this invention is not limited to lighting systems. As noted above, ambiance can be affected by other stimuli, such as aroma, sound, temperature, and so on. The iterative adjustment-feedback training disclosed herein may be used, for example, to determine optimal settings for a home-audio system, a heating/cooling system, and so on, in addition to the example lighting system of this disclosure.

Figure 1:
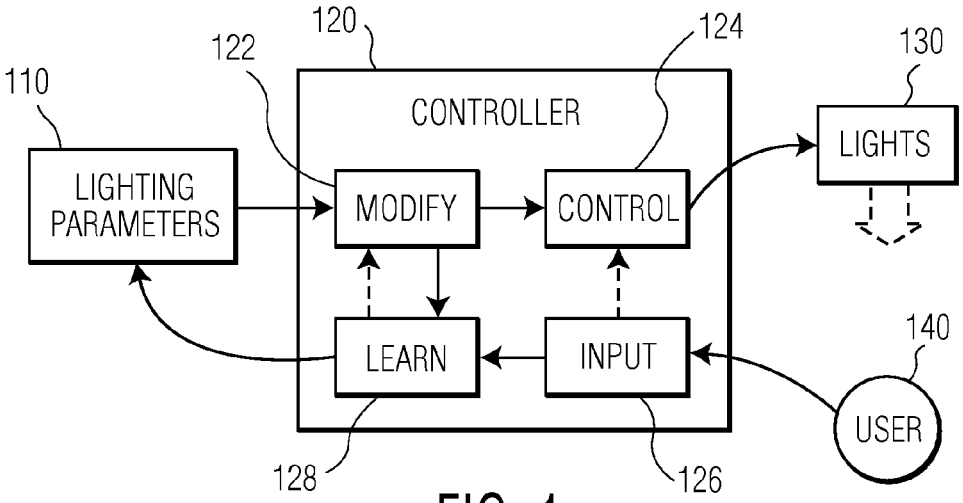
FIG. 1 illustrates an example block diagram of a lighting system in accordance with this invention.

FIG. 1 illustrates an example block diagram of a lighting system, comprising a memory 110 that is configured to contain sets of lighting parameters, and a controller 120 that is configured to control one or more lights 130 based on the lighting parameters.

In accordance with this invention, the controller 120 includes a modification module 122 that is configured to introduce a change to one or more of the lighting parameters that are read from the memory 110, and a control module 124 that controls the lights 130 based on the resultant lighting parameters.

A user 140 in the environment being illuminated provides feedback to an input port 126 of the controller 120, and, based on this feedback, a learning module 128 modifies the lighting parameters 110, or the modification module 122 to encourage further improvements along the same direction if the feedback was positive, or discourage further modifications along that direction if the feedback was negative.

The term "direction" is used herein in a generic sense. Using techniques common in the art, the set of parameters can be defined as a point in a multidimensional space, and the direction is relative to this multidimensional space. Other models and techniques may be used to represent the set of parameters and changes to the set; for example, a neural-network learning model may be used, wherein direction is relative to changes in the weighting functions at the nodes of the network. A positive feedback will cause certain weighting functions in the network to increase or decrease, to provide/encourage similar changes in the future, while a negative feedback with cause a different set of increases or decreases of the weights at the nodes to avoid/discourage such changes in the future.

Figure 2:
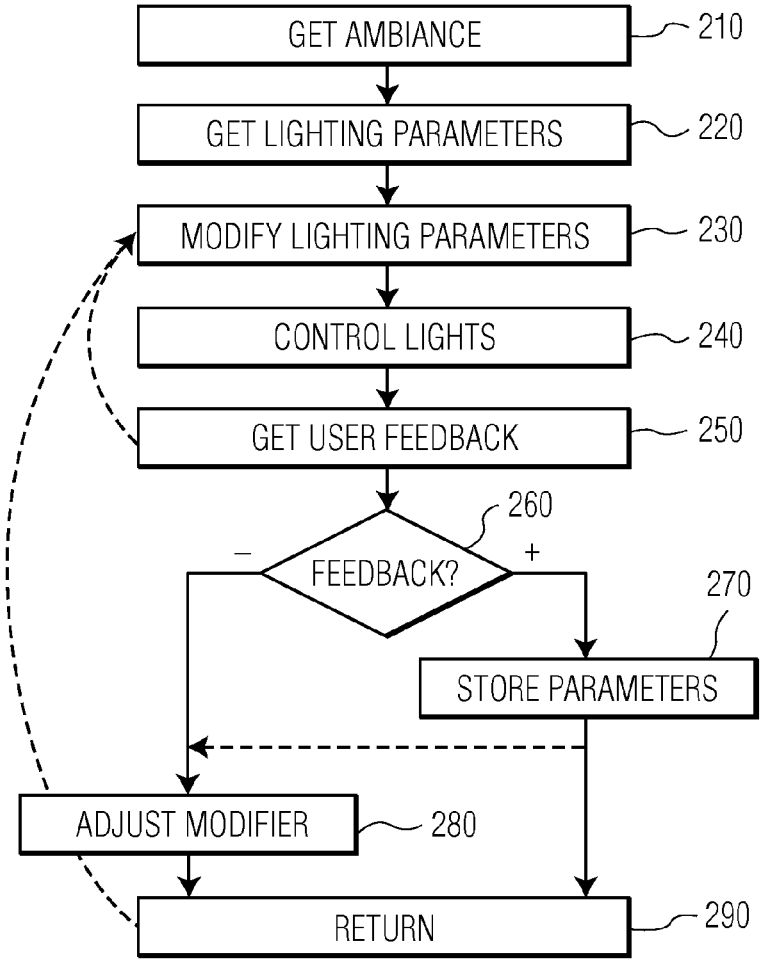
FIG. 2 illustrates an example flow diagram of a lighting system in accordance with this invention.

The functions of the components of FIG. 1 are best illustrated by the example flow diagram of FIG. 2. It is noted that the particular flow of FIG. 2 is provided for ease of illustration, and is not intended to limit the spirit or scope of this invention, and is not intended to imply a limitation to the functions or interactions of the modules of FIG. 1.

At 210, the desired ambiance is selected by the controller 120, and the corresponding lighting parameters are retrieved from the memory 110, at 220.

Preferably, each set of lighting parameters in the memory 110 corresponds to a given 'ambiance' or 'desired-effect'. Typically, a number of pre-defined sets of parameters are provided by the manufacturer of the system, including, for example, sets corresponding to "reading", "watching TV", "romantic", "party", and other popular effects. Alternatively, or additionally, the system may be configured to learn other sets of parameters by monitoring a user's control of the lighting system. Conventional techniques, such as clustering, can be used to define and distinguish commonly used sets of parameters based on repeated user control of the system. Similarly, using conventional machine-learning techniques, the system can associate different sets of parameters to particular times of the day, different days of the week, different weather conditions, different seasons, and so on. In like manner, the system can be coupled to other sensors and different sets of parameters may be associated with inputs from these sensors. For example, the amount of ambient light, the activity occurring in the environment being illuminated, the number of people occupying the affected area, the ambient temperature, and so on may affect the choice of a set of parameters for achieving a particular ambiance. Optionally, the user may directly choose a desired ambiance.

At 230, the modification module 122 modifies one or more of the parameters of the selected set, and the control module 124 adjusts the lights 130 based on the modified set of parameters. Depending upon the particular lights 130 and the form of the parameters, the control module 124 may communicate the parameters directly to the lights 130, or the control module 124 may be configured to effect a transformation of the parameters into control signals that are communicated to the lights, or a combination of both, depending upon the individual parameters. This transformation may also include the use of other parameters, such as the amount and/or color content of the ambient light, and other external factors.

Preferably, the controller 120 provides the modification in a non-obtrusive manner, except when specifically activated in a "fast-learning" mode, discussed below. Any of a variety of schemes can be used to provide substantially non-obtrusive changes. For example, each time the system is activated to turn the lights on, a slight change to the selected parameters can be introduced. If the user notices the change, the user can provide immediate feedback, using for example, "thumbs-up" or "thumbs-down" buttons on a device coupled to the controller 120. Alternatively, the user can enter a rating, for example, from a scale of +/−N, where 0 is "no-opinion", and the magnitude N of the + or − rating indicate the degree of the user's pleasure/displeasure with the change.

In most cases, the change will be slight and not consciously noticed by the user 140. In these cases, the controller 120 is configured to obtain the user feedback in a less overt manner. In one embodiment, the controller 120 may be configured to deduce the feedback based on a time duration, using, for example, the assumption that if the user does not expressly signal discontent with the change within a given period, the feedback is positive. (For ease of reference, the term "positive" includes "zero", or "no preference one way or the other".) In another embodiment, the control device that is coupled to the input port 126 of the controller 120 includes two switches for terminating the current ambiance. When the user is ready to turn the lights off, or to change to a new ambiance, the user selects one of the turn-off buttons to signal positive feedback, and the other turn-off button to signal negative feedback. Additional switches may be provided to indicate the magnitude of the user's feedback.

Note that, in the non-obtrusive mode, because the modifications are preferably slight, many modify-feedback cycles will be required to reach an optimal set of parameters for each ambiance, and the cycles-times are relatively long. But, because these cycles are non-obtrusive, the weeks or months that it may take for the system to optimize the parameters for a desired ambiance in a given environment is of no consequence to the user.

In a preferred embodiment of this invention, the modifier module 122 is configured to provide modifications whose magnitudes vary inversely with the amount of feedback received for a given ambiance. That is, for example, when a given ambiance is first selected, the modification may be consciously noticeable, to give the learning module 128 an initial search direction, or an initial coarse-tuning As more and more feedback samples are obtained, the module 128 is likely to be converging on the optimal, and the changes are purposely smaller to fine-tune the settings. Conventional techniques for detecting a lack of convergence can be applied, and conventional solutions can be applied to correct the problem. For example, if the module 128 appears to be oscillating, which is often an indication of multiple local-optimal solutions, the selected ambiance may be partitioned into two independent ambiances, and each of these partitioned ambiances can be locally optimized. Thereafter, a correlation to other parameters, such as time of day or ambient lighting, to each of the partitioned ambiances can be determined to facilitate the proper choice between these ambiances, at 210. Other machine-learning techniques can be applied to facilitate the search for an optimal set of parameters for each ambiance using the modify-feedback aspect of this invention, as would be evident to one of ordinary skill in the art in view of this disclosure.

In a "fast-learning" mode, the controller 120 is configured to provide quicker modify-feedback cycles. In an example fast-learning embodiment, the controller 120 is configured to sample continuously for the user's feedback, and to execute the loop 230-250 (or 230-290) each time the user's feedback is received, or after a short time duration, such as a half-minute or so, whichever occurs first. In an alternative embodiment, the controller 120 and modification module 122 are configured to provide two different sets of parameters to the lights 130 in a short time period, and to receive feedback from the user as to which of the two are preferred. Other techniques for explicitly training the system will be evident to one of ordinary skill in the art in view of this disclosure. For example, the user may be provided with more than two different sets of parameters from which to choose, or to evaluate on a ranking scale. Similarly, the system may be configured to adjust the parameters to provide a slow but continual change, and the user signals a limit to each change, thereby providing a range of parameters for further optimization.

In a straightforward embodiment of the invention, the learning module 128 may merely be configured to control the direction of search for improved parameters, and merely replaces the stored parameters for the ambiance with the modified parameters when favorable feedback is received, at 260-270 of FIG. 2. When negative feedback is received, at 260, the learning module 128 controls the modification module 122 so as to change the direction of the search.

In a preferred embodiment of this invention, the learning module 128 includes a machine-learning process that is configured to search for an optimum response to a multi-variate stimuli. There are typically many lighting parameters associated with a desired ambiance, and the learning module 128 is preferably configured to optimize its search for an optimal set of parameters for each ambiance. To achieve this optimized search, each of the parameters in the sets of parameters may be assigned a weight, or priority, based on an assumed significance of this parameter relative to other parameters in the set. For example, overall brightness/luminance is likely to be the most significant parameter in most of the ambiances, although some ambiances may be affected more directly by color, or color saturation. In one embodiment of this invention, the controller 120 is pre-programmed with the weight/priority of each parameter field in the memory 110; in another embodiment, the controller 120 includes an Internet access device that is configured to obtain the latest "wisdom" from select sources as to which parameter field is most significant to the current ambiance.

To reduce the complexity of the optimization process, the learning module 128 may be configured to treat some parameters as independently variable parameters, and others as related parameters. For example, the overall brightness or luminance can generally be treated as an independent parameter, whereas hue and saturation are preferably treated as related parameters. Independent variables are generally adjusted in a strictly sequential manner, whereas related variables are generally adjusted in combination with each other, or alternately adjusted individually. When the variables are related, the multiple individual feedback responses are typically processed to determine correlations among the responses before the learning module 128 effects a change to the stored parameters, using techniques common in the art of multi-variate analysis and machine learning. In a preferred embodiment of this invention, the interrelationships among variables may be dynamically adjusted. For example, the overall brightness or luminance is initially treated as an independent variable, to quickly approach a preferred setting, and then treated as a related variable to achieve a fine-tuning of this parameter in relation to the other parameters.

Note that the above description of this invention used the paradigm of a single user. One of ordinary skill in the art will recognize that the principles of this invention could be applied to different scenarios.

In a commercial environment, such as a hotel room, office building, conference room, and so on, the feedback from multiple users may be used to determine optimal lighting settings. For example, a hotel room may be configured to provide a "welcome" ambiance when guests enter their room, providing a slight change each time, and recording whether the guests adjust the lights upon entry. Different welcome ambiances can be provided depending upon the time of day, day of week, current weather conditions, and so on. In like manner, different ambiances can be provided after "turn-down" services are provided, and iteratively adjusted to determine optimal settings based on the guests' reactions upon reentry. In such a scenario, the learning system may be configured to receive the feedback directly from each of the multiple environments, such as from each of similar hotel rooms, or, individual learning systems may be provided in each environment, and a supervisory system may be used to formulate preferred ambiances based on a composite of the ambiances derived at the individual systems.

In like manner, it is known that ambiance can affect the outcome of business meetings. The Kurhaus Hotel in the Netherlands, for example, provides a "Result Room", wherein the lighting and aroma of a meeting room are adjusted to present an environment conducive to a particular meeting objective. For example, if a negotiating meeting is planned, the room's color is set to blue, and an aromatic mix of chamomile, lavender, and sage is diffused through the room; if a decision-making meeting is planned, the room's color is set to red, and an aromatic mix of lemon, rosemary, and cedar is provided; if an idea-forming meeting is planned, the room's color is set to yellow, and an aromatic mix of bergamot, orange, and rosewood is provided. Other combinations of colors and aromas, including user-defined lighting and aromatic effects, are also available. An embodiment of this invention in such an environment would include making slight adjustments to the lights and/or fragrances, and surveying the meeting coordinators, or each of the attendees to determine whether the meeting achieved its objectives. That is, the feedback need not directly address whether the user found the lights and/or fragrances to be favorable or unfavorable, but rather whether the ambiance provided the desired result. In this manner, the conventional choices of lighting and fragrance combinations to achieve particular results can be tested and fine-tuned in a non-intrusive manner, and new combinations may be discovered.

The foregoing merely illustrates the principles of the invention. It will thus be appreciated that those skilled in the art will be able to devise various arrangements which, although not explicitly described or shown herein, embody the principles of the invention and are thus within its spirit and scope. For example, although this invention is presented in terms of a stand-alone system that modifies parameters for a specific location, one of ordinary skill in the art will recognize that the techniques of this invention can be used to provide feedback to the original designers of the lighting control system, or to third-party service providers, to facilitate the development of improved sets of lighting and scent parameters for pre-defined ambiances. That is, for example, the system can be configured to communicate determined sets of parameters, or sets of changes, to the original designers and/or third-party providers, and to receive other optimized sets of parameters from other users of this invention, or composites of optimized sets from the designers and/or third-party providers. By coupling a user's control system to a provider of the results of other modify-feedback experiences, the optimization of the user's control system can be expected to be accelerated, particular in the initial rounds of training epochs. These and other system configuration and optimization features will be evident to one of ordinary skill in the art in view of this disclosure, and are included within the scope of the following claims.

In interpreting these claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) each of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts is intended to be required unless specifically indicated; and i) the term "plurality of" an element includes two or more of the claimed element, and does not imply any particular range of number of elements; that is, a plurality of elements can be as few as two elements.

The invention claimed is:

1. A system for providing an ambiance to an environment, comprising:

a memory, a controller, operably coupled to the memory and configured to:

recall a selected set of parameters from the memory, modify the selected set of parameters to produce a modified set of parameters, control one or more ambiance-affecting devices based on the modified set of parameters, obtain feedback from a user related to the modified set of parameters, and selectively store one or more parameters in the memory, based on the feedback and the modified set of parameters, wherein the ambiance-affecting devices include one or more lights, and the controller is configured to control the one or more lights so as to affect one or more of the following: saturation, brightness, distribution of light, and distribution of color.

2. The system of claim 1, wherein the ambiance-affecting devices include at least one of:

audio-devices, and fragrance-dispensers.

3. The system of claim 1, wherein the controller is configured to recall the selected set of parameters based on at least one of:

a time of day, a date, a day of a week, a weather condition, a measure of ambient light, an occupancy measure, an activity of the user, and a control input.

4. The system of claim 1, wherein the controller is configured to modify the selected set of parameters by adjusting one or more of the parameters based on a predefined selection criteria.

5. The system of claim 1, wherein the controller is configured to obtain the feedback from the user based on at least one of:

activation of one of a plurality of switches, a time duration, a control input, and an external control of the one or more ambiance-affecting devices.

6. The system of claim 1, further including a feedback component that includes a plurality of switches, that is configured to provide the feedback from the user, and to provide a control input to the controller.

7. The system of claim 1, wherein the controller includes a learning machine that is configured to process prior feedback from the user, and to modify the selected set of parameters based on the prior feedback.

8. The system of claim 7, wherein the learning machine is also configured to facilitate selection of the selected set of parameters, based on the prior feedback.

9. The system of claim 7, wherein the learning machine is also configured to provide an explicit learning mode, in which mode:

the controller is configured to:

produce a plurality of modified sets of parameters, based on the selected set of parameters from the memory control the one or more ambiance-affecting devices based on each of the plurality of modified sets, and obtain additional feedback from the user related to the plurality of modified sets, and the learning machine is configured to modify the selected set of parameters based on the additional feedback.

10. The system of claim 1, wherein the controller is further configured to:

modify the selected set of parameters based on a magnitude and direction of change, and adjust at least one of the magnitude and direction based on the feedback.

11. The system of claim 1, wherein the system is further configured to provide ambiance to a plurality of environments, based on a plurality of feedbacks, and the controller is further configured to control one or more ambiance-affecting devices in each of the other environments in the plurality of environments, and obtain other feedback of the plurality of feedbacks from users in the other environments, and selectively store the one or more parameters in the memory based on the plurality of feedbacks.

12. A method of determining preferred ambiance-affecting parameters, comprising:

recalling a first set of ambiance-affecting parameters from a memory, modifying the first set to provide a second set of ambiance-affecting parameters, controlling one or more ambiance-affecting devices in an environment based on the second set, obtaining feedback from a user in the environment, and determining the preferred ambiance-affecting parameters based on the feedback from the user in the environment, wherein the ambiance-affecting devices include one or more lights, and controlling the ambiance device includes controlling the one or more lights so as to affect one or more of the following: saturation, brightness, distribution of light, and distribution of color.

13. The method of claim 12, further including determining at least one selection factor based on at least one of:

a time of day, a date, a day of a week, a weather condition, a measure of ambient light, an occupancy measure, an activity of the user, and a control input, and wherein recalling the first set of ambiance-affecting parameters is based at least in part on the at least one selection factor.

14. The method of claim 12, wherein obtaining the feedback includes detecting at least one of:

activation of one of a plurality of switches, a time duration, a control input, and an external control of the one or more ambiance-affecting devices.

15. The method of claim 12, further including storing feedback information based on the feedback, and wherein determining the preferred ambiance-affecting parameters is further based on the prior feedback information.

16. The method of claim 12, further including:

providing a plurality of sets of ambiance-affecting parameters, controlling the one or more ambiance-affecting devices based on each of the plurality of sets of ambiance-affecting parameters, and obtaining additional feedback from the user, wherein determining the preferred ambiance-affecting parameters is further based on the additional feedback.

* * * * *